US006000142A

United States Patent [19]

Deaton

[11] Patent Number: 6,000,142

[45] **Date of Patent: *Dec. 14, 1999**

[54] PICTURE HANGING LOCATOR DEVICE

[76] Inventor: Richard Eugene Deaton, 30 Faith Dr., Franklin, N.C. 28734

[ * ] Notice: This patent is subject to a terminal disclaimer.

[21] Appl. No.: 08/137,724

[22] Filed: Oct. 18, 1993

[51] Int. Cl.[6] ..... B25H 7/00

[52] U.S. Cl. ..... 33/613; 33/666

[58] Field of Search ..... 33/613, 666, 679, 33/574, 577; 248/544, 547, 468

[56] References Cited

U.S. PATENT DOCUMENTS

| | | | |
|---|---|---|---|
| 1,043,902 | 11/1912 | Burdick | 33/574 X |
| 2,805,484 | 9/1957 | D'Aoust | 33/427 X |
| 3,495,334 | 2/1970 | Yamamoto | 33/27.03 |
| 3,624,911 | 12/1971 | Max | 33/578 X |
| 3,797,118 | 3/1974 | Yamamoto | 33/27.03 |
| 4,382,337 | 5/1983 | Bendick | 33/613 X |
| 4,473,957 | 10/1984 | Faulkner | 33/613 |
| 5,109,661 | 5/1992 | Houck | 33/666 X |
| 5,129,154 | 7/1992 | Aydelott | 33/666 X |

*Primary Examiner*—William A. Cuchlinski, Jr.
*Assistant Examiner*—Alvin Wirthlin

[57] ABSTRACT

An apparatus for locating the hanging hardware of a picture on a wall, includes a rectanglar block having an inverted "V" shaped slot on a rear surface thereof for receiving a mounting wire or string. The block further includes a blunt protrusion located directly below the point of the "V" for marking a wall. A "U" shaped member connected by a spring to the block is provided for receiving the top portion of the frame.

1 Claim, 2 Drawing Sheets

PICTURE HANGING LOCATOR DEVICE

BACKGROUND OF INVENTION

The invention relates to an apparatus and method of locating the nail, hook, or other device, used to hang a picture frame, or mirror, or other object, on a wall. It provides a method of marking the wall at the proper site for the hanging device, in order that the frame will hang in the precise position desired.

It has been customary for persons wishing to hang a picture to hold the frame in the desired mounting position, and attempt, with a finger, pencil, or other object, to locate and mark the correct location for installation of the hanging hardware. This method is highly imprecise, and can be very awkward. It requires that the installer hold the frame away from the wall, and insert the pencil, or finger, between the frame and the wall, to mark the place where the hanger is to be installed. With either of these methods, the user can only mark the approximate location where the hanger should be placed. The pencil method has an additional disadvantage in that it makes disfiguring marks on the wall, often covering areas far removed from the actual hanger site, and sometimes, including random marks that are accidentally placed on the wall, when the pencil is inserted or removed. The finger method also has another major disadvantage, since it requires the person to keep his finger in the correct location on the wall, while putting down the frame, and retrieving a hammer and nail, a marker, or some other device for permanently indicating the location of the hanging hardware.

Several approaches have been provided for locating the precise location for the nail, or other supporting device. Faulkner, in U.S. Pat. No. 4,473,957 teaches a hanger locating device that fits over the top surface of the frame, with a projection to engage the wire, or string used to mount the frame, and a tensioning screw to secure the device to the frame, while applying tension to the string, or wire. Once the frame and locating device have been assembled together, and positioned on the wall, a pin is pushed through a channel in the apparatus, and into the wall. This device is usually limited to single point installations, which use a wire, or string, to mount the frame. It does not provide for the need to mount frames which have mounting brackets installed on the rear of the picture, nor, does it adapt to pictures that require more than one mounting point. This apparatus will not fit on all frame sizes.

Another approach is taught by Floyd, in U.S. Pat. No. 4,893,776. This art discloses a picture hanging tool which incorporates a hook for holding the picture and a handle having a plunger which can be used to extend and retract a marker, which places a mark on the wall, in the correct location for the hanging hardware. This device will not adapt to picture hanging close to the ceiling, as the hardware of the device needs a certain amount of clearance, and, it is not suitable for use in two point mountings.

SUMMARY OF THE INVENTION

Accordingly, it is an object of this invention to provide an apparatus and method for locating the hanging hardware used to hang a picture in a precise and reliable manner.

Another object of this invention is to provide a picture hanging locator device which uses simple components, and does not require periodic maintenance to retain its effectiveness.

Another object of this invention is to provide a picture hanging locator device which clearly indicates the correct location for the hanging hardware, but does not make unnecessary disfiguring marks on the wall.

Still another object of this invention is to provide a picture hanging locator device which can be easily used for two point mountings, using two brackets on the back of the frame, as well as for single point mountings using one bracket, or wire.

Yet another object of this invention is to provide a picture hanging locator device which can be used with all types and sizes of frames.

In carrying out this invention in the illustrative embodiment thereof, a picture, having a mounting block attached to the rear of the picture is used. Now, a picture hanging locator device is provided, having a generally rectangular shape, and formed from a suitable material which will mark the area to be used, but, will not permanently damage the area. A vertical slot is formed into the bottom of the rectangular block, and extends a distance up through the interior of the block. This slot is slipped down over the bracket on the back of the frame to be mounted. At this point, the picture frame, with the locator device installed over the bracket, is then positioned on the wall, at the location where it is to be hung.

Now, the locator device has a conical, dull, protrusion, or blunt tack, extending rearward from the surface which will contact the wall. This tack is located on the locator device such that when the locator device is installed over the mounting bracket, it extends from the horizontal center of the block, just below the bottom of the bracket. Thusly, the tack is positioned precisely where the mounting nail will be installed. The user positions the picture in the precise location desired, and merely presses the picture against the wall, and the tack makes a minute indentation in the wall surface. The frame, with the locating device installed, is then removed from the wall, and the indentation remains on the wall in the precise location of the nail to be used.

The user drives a nail, or other hanging device in the indentation, and the picture can be hung in that precise location.

When a picture uses two such mounting brackets, the user slips a locator device over each bracket, positions the picture on the wall, and presses each locator against the wall, and two indentations will be formed. A nail is driven into each of these indentations, and the picture is hung in the precise location desired.

It should be noted that the size of the picture does not alter the efficiency of this locator device.

For those pictures using a wire, or string, for hanging purposes, a different arrangement of the marking block is used. In this embodiment of the invention, an eye bolt arrangement is screwed, or otherwise imbedded into the extreme top of the locator device, and a spring arrangement is attached onto the eye bolt, and the spring extending upward and attached to a "U" shaped bracket which mounts over the top of the picture frame.

Also, the slot formed in the bottom of the locator device is eliminated, and replaced by an inverted "V" shaped slot, which is located on the same surface as the blunt tack, and begins at the edges of the block, adjacent the tack, and angles upward, in an inverted "V" shape, reaching a peak, or, the point of the inverted "V", just above the point of the blunt tack. In operation, the bracket is installed over the top of the picture, and the user grasps the hanging wire, and places it in the slot, which is on the rear of the locator device, and the wire is captured in the slot by the spring tension of the attaching spring. Again, the blunt tack is located precisely at the point on the "V" shaped slot where the nail will be placed. Now, pressing the blunt tack against the wall leaves an indentation on the wall, marking the precise location of the mounting nail. The picture is removed, the locating device is removed, a nail is driven into the wall at the point of the indentation, and the picture can be hung in the desired location.

Conveniently, the user may install the locator device on the rear of a picture, either a wire hung picture, or a picture using brackets, gently press the locator device against the wall, and an indentation is formed in the precise location of the required nail to hang the picture. Using this device will allow for locating either one picture, or a series of pictures in an arrangement. In those instances where the user changes mind about the location of a picture after using this locator device, as a blunt tack type point is used on the invention, no discernable disfiguring mark is left on the wall.

BRIEF DESCRIPTION OF THE DRAWINGS

This invention, together with other objects, features, aspects and advantages thereof, will be more clearly understood from the following description, considered in conjunction with the accompanying drawings.

Two sheets of drawings are furnished. Sheet one contains FIG. 1 and 2. Sheet 2 contains FIGS. 3, 4, and 5.

DESCRIPTION OF THE PREFERRED EMBODIMENTS

Figure 1:
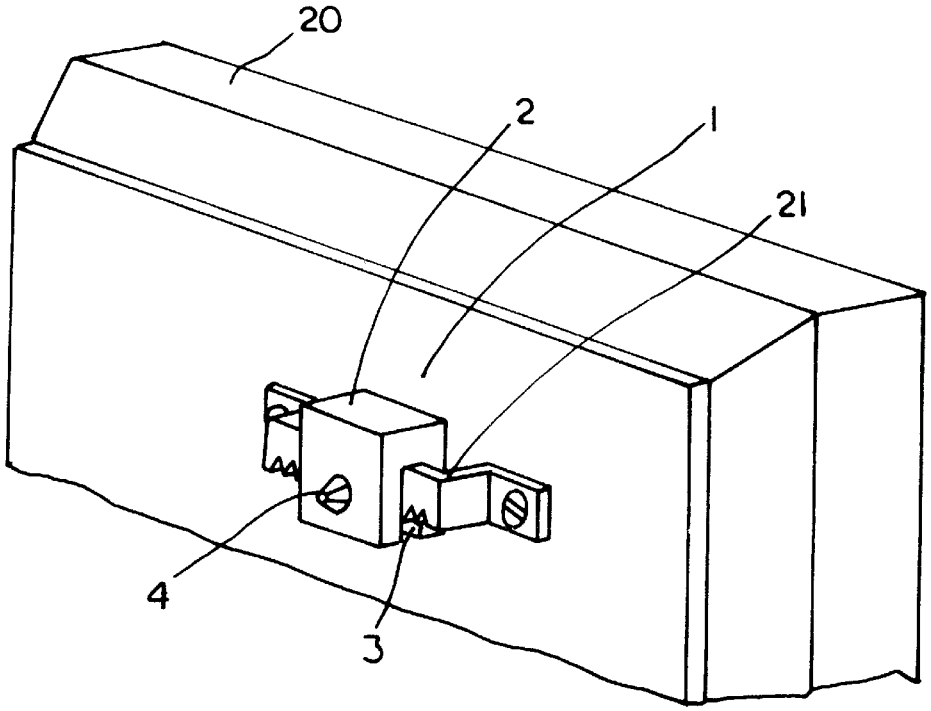
FIG. 1 is an isometric view of the picture hanging locator device in the embodiment for a picture using a mounting bracket.

Referring now to FIG. 1, a picture hanging locator device, referred to generally by the reference numeral 1 is made of a suitable material, and comprises a locator block 2 having a generally rectangular shape.

Now, rectangular locator block 2 has slot 3 formed into its bottom center surface, and extending vertically through the body of block 2, and ending approximately one third of the distance from the top of block 2. Slot 3 has a width which allows it to fit onto mounting bracket 21, of picture frame 20.

Now, and still referring to FIG. 1, locating block 2 has conical tack 4 extending from its rear surface, in order that tack 4 points toward the wall, when block 2 is installed over the mounting bracket 21. To mark the correct position for installing the picture hanging hardware, block 2 is installed over, and moved to the center of bracket 21. Picture frame 20, with locating block 2 installed thereon, is then positioned at the location in which it is to be hung. the user now presses frame 20 against the wall, in order that tack 4 makes an indentation in the surface of the wall. Frame 20 can then be removed, and the mounting hardware installed at the marked location. Finally, locator block 2 is removed from bracket 21, and frame 20 can be hung on the wall in the precise location desired.

Figure 2:
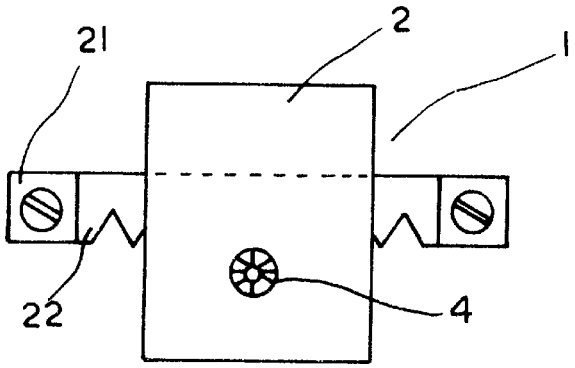
FIG. 2 is a front elevation of the invention, showing the conical protrusion, or, blunt tack.

Now, and referring to FIG. 2, we see a front view of locator block 2, in which can be clearly seen that conical tack 4 is located at the horizontal center of block 2, and at a vertical position that ensures that it will be just below bottom edge 22 of mounting bracket 21.

Figure 3:
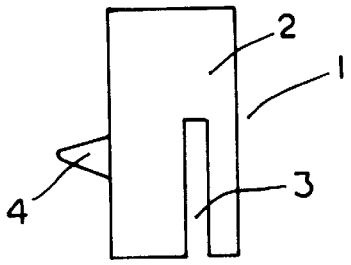
FIG. 3 is a side view of the locator device, showing the slot and the blunt tack.

Progressing now to FIG. 3, we see a side view of locator block 2, which shows the relative positions of slot 3, and tack 4 in greater detail.

Figure 4:
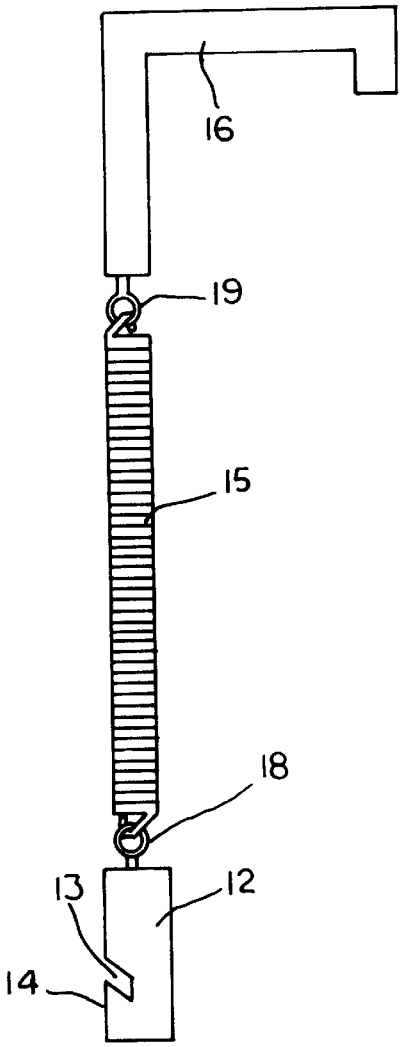
FIG. 4 is a side view of the invention, showing the embodiment for locating pictures which use a wire for mounting.

FIG. 4 presents and alternate embodiment of the invention which is adapted for use with frames having a mounting wire or string attached to the rear of the picture. In this embodiment, locating block 12 is supported by spring 15, which connects to block 12 by eye bolt 18. The other end of spring 15 is supported by hook 16, which is installed over the top surface of picture frame 20, more easily seen in FIG. 1, and connects to spring 15, by eye bolt 19. For frames which use a mounting wire across their rear surface, slot 13 is provided in block 12 for purpose of engaging the wire. Slot 13 is formed into block 12 in an angular manner, in order that it reaches peak 17, shown more clearly in FIG. 5, directly above the point of tack 14.

Now, to correctly mark the location of frame mounting hardware, using this embodiment of the invention, the wire is inserted into slot 13, and hook 16 is installed over the top surface of frame 20, and is held there by spring tension of spring 15. Hook 16 is then moved to the horizontal center of frame 20, and locating block 12 is adjusted to ensure that spring 15 remains vertical. Frame 20 is then positioned at the location in which it is to be installed, and pressed against the wall. This causes tack 14 to make an indentation in the wall at the correct location for the hanging hardware.

Figure 5:
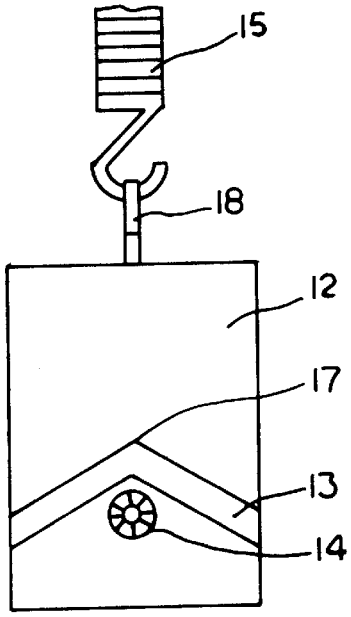
FIG. 5 shows a front view of the locator device, as it would be used for attaching the wire in the slot, for those pictures using a wire for hanging purposes.

Referring now to FIG. 5, we see a front view of locating block 12, where the relationship between slot 13, and tack 14 can be more clearly seen.

Accordingly, a very unique, attractive, convenient method and apparatus are provided for locating the desired location for installing the hardware used to hang a picture, mirror, or other similar object. This apparatus requires no special knowledge on the part of the user, and needs no maintenance of any kind. It can accommodate any type or size of frame, and allows the user to install the frame at any location on the wall, even at the very top of the wall. It is easily adaptable to single point and multi point mountings, and allows the user to precisely mark the correct hanging hardware position, without unnecessarily disfiguring the wall.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. A picture hanging locating device, for locating a picture, or other object on a wall, at any location on said wall, said picture employing a wire, or string mounting arrangement, comprising:

a substantially rectangular block of suitable material, said block having a bottom surface, a top surface, a rear surface, a front surface, a right end surface, and a left end surface, said block having an inverted "V" shaped slot formed in its rear surface, each side of said inverted "V" shaped slot beginning a distance from said bottom surface, and extending angularly upwardly to meet at the center of said rear surface, said slot extending forward into said rear surface of said block, and downward at an angle, said block also having a blunt protrusion extending from its rear surface, at a location directly below the point where said inverted "V" shaped slot is at its peak on said rear surface of said block, and, at a location where mounting wire, or, string, of said picture frame would be required, to hang said picture at a desired location, said block having a spring affixed onto said top surface, said spring extending from said top surface of said block, upwards, to a substantially "U" shaped piece of material, said "U" shaped piece of material having a rear downwardly extending portion, a horizontal top portion, and a shorter front downward extending portion, and said spring arrangement having affixing means between said block and said rear downwardly extending portion of said "U" shaped piece of material, and said horizontal top portion of said "U" shaped piece of material being adapted to fit over the top of said picture frame, and said "U" shaped piece of material being retained thereon by said shorter front downward extending portion and, tension of said spring.

* * * * *